US009370207B2

(12) United States Patent
Crowder

(10) Patent No.: US 9,370,207 B2
(45) Date of Patent: Jun. 21, 2016

(54) METHOD OF CORE COOLING

(71) Applicant: Urve Kask Crowder, Winchester, VA (US)

(72) Inventor: Urve Kask Crowder, Winchester, VA (US)

( * ) Notice: Subject to any disclaimer, the term of this patent is extended or adjusted under 35 U.S.C. 154(b) by 0 days.

(21) Appl. No.: 14/545,767

(22) Filed: Jun. 16, 2015

(65) Prior Publication Data

US 2016/0095360 A1 Apr. 7, 2016

Related U.S. Application Data

(62) Division of application No. 14/121,640, filed on Oct. 1, 2014, now Pat. No. 9,089,176.

(51) Int. Cl.

| | |
|---|---|
| ***A61F 7/00*** | (2006.01) |
| ***A61F 7/02*** | (2006.01) |
| ***A61F 7/10*** | (2006.01) |
| ***A41D 13/005*** | (2006.01) |
| ***A41D 19/015*** | (2006.01) |
| ***A41D 19/00*** | (2006.01) |

(52) U.S. Cl.

CPC ..... *A41D 13/0053* (2013.01); *A41D 19/0027* (2013.01); *A41D 19/0037* (2013.01); *A41D 19/01541* (2013.01)

(58) Field of Classification Search

CPC ..... A41D 13/0053; A41D 13/0058; A61F 2007/0036

See application file for complete search history.

(56) References Cited

U.S. PATENT DOCUMENTS

| | | | | |
|---|---|---|---|---|
| 5,035,003 | A | 7/1991 | Rinehart | |
| 5,050,596 | A | 9/1991 | Walasek et al. | |
| 5,623,731 | A | 4/1997 | Ehrgott et al. | |
| 6,009,713 | A | 1/2000 | Horn | |
| 6,141,801 | A | 11/2000 | Helenick | |
| 6,602,277 | B2 | 8/2003 | Grahn et al. | |
| 6,656,208 | B2 | 12/2003 | Grahn et al. | |
| 6,673,099 | B2 | 1/2004 | Grahn et al. | |
| 6,966,922 | B2 | 11/2005 | Grahn et al. | |
| 6,974,442 | B2 | 12/2005 | Grahn et al. | |
| 7,122,047 | B2 | 10/2006 | Grahn et al. | |
| 7,182,776 | B2 | 2/2007 | Grahn et al. | |
| 7,862,600 | B2 | 1/2011 | Grahn et al. | |
| 7,947,068 | B2 | 5/2011 | Grahn et al. | |
| 8,066,752 | B2 | 11/2011 | Hamilton et al. | |
| 8,177,826 | B2 | 5/2012 | Grahn et al. | |
| 8,277,496 | B2 | 10/2012 | Grahn et al. | |
| 8,287,581 | B2 | 10/2012 | Grahn et al. | |
| 8,603,150 | B2 * | 12/2013 | Kane | A61F 7/02 607/111 |
| 8,617,230 | B2 | 12/2013 | Diller et al. | |

(Continued)

*Primary Examiner* — Kaitlyn Smith

(57) ABSTRACT

A core cooling method includes a hand covering configured as a glove having a palm portion and a wrist portion. The glove also includes an outer layer and an inner liner. An access opening in the palm portion of the outer layer permits access between an outer surface of the outer layer and a pocket in a space between the outer layer and the inner liner. A cooling element is positioned within the pocket and adjacent the access opening in the palm portion of the outer layer. A tubular air passage is connected to the exterior surface of the glove and communicates with the interior of the inner liner permitting air to be withdrawn from the interior of the inner liner.

18 Claims, 5 Drawing Sheets

(56) References Cited

U.S. PATENT DOCUMENTS

| | | | | |
|---|---|---|---|---|
| 8,641,745 | B2 | 2/2014 | Warner et al. | |
| 2004/0244090 | A1 | 12/2004 | Langer | |
| 2008/0132976 | A1* | 6/2008 | Kane | A61F 7/02 607/104 |
| 2008/0234788 | A1* | 9/2008 | Wasowski | A43B 7/34 607/104 |
| 2009/0326622 | A1 | 12/2009 | Johnson et al. | |
| 2011/0022138 | A1* | 1/2011 | Warner | A61F 7/02 607/114 |
| 2012/0191022 | A1* | 7/2012 | Muehlbauer | A61F 7/0053 601/18 |
| 2013/0190667 | A1* | 7/2013 | Kane | A61F 7/02 601/149 |

* cited by examiner

METHOD OF CORE COOLING

CROSS-REFERENCE TO RELATED APPLICATION

This application is a division of U.S. patent application Ser. No. 14/121,640 filed Oct. 1, 2014, now U.S. Pat. No. 9,089,176.

TECHNICAL FIELD

The present disclosure relates to core cooling and, more particularly, to a core cooling accessory and method.

BACKGROUND

It is generally recognized that exercise is beneficial for good health and a sense of wellness. Health care personnel consistently recommend regular moderate to rigorous exercise for most individuals regardless of age. Sale of exercise equipment is a large and growing business sector. Health clubs and gymnasiums are common in populated areas. Today, a large segment of the population engages in some form of exercise, and it is the norm to see young and old, male and female, working out regularly in health clubs. At least in some communities, and at certain times of the day, the majority of those exercising in fitness facilities may be elderly persons. Indeed, it is not uncommon to see elderly persons with infirmities, aided by walkers, wheelchairs, and/or oxygen assist equipment, for example, engaging in exercise routines at health clubs.

In order for one to receive the benefits of exercise, it is generally necessary for her or him to continue the exercise session for a period of time. That period of time may vary depending on the general health and age of the exerciser, and may, for example, be anywhere from less than an hour to three hours or more. While exercising for a time period sufficient to gain any benefit from the exercise activity may be easy enough for a young, healthy person, it may be much more difficult for older persons.

Numerous expedients have been proposed to assist persons in maintaining the stamina needed to complete a session of moderate to rigorous exercise. For example, various energy drinks and food supplements have been touted as increasing energy levels and helping to sustain an individual during periods of relatively intense activity. In addition, much has been made of the use of various pharmaceuticals, such as, for example, anabolic steroids, to assist exercise performance. Energy drinks and food supplements, debatably, may be of some limited value in enabling one to maintain a period of rigorous exercise. Pharmaceuticals, on the other hand, implicate major body chemistry and serious side effects which strongly militate against their use.

Situations may occur where a person may have spent a considerable period of time neglecting regular exercise and otherwise failing to maintain good health habits. For example, many older persons have only begun to follow an exercise regimen as they have reached retirement age. Their lack of activity may have resulted in obesity and/or significant muscle atrophy. Often their progress is slow because they simply do not have the stamina to exercise with sufficient intensity and duration. They may become discouraged by their lack of progress and, to their detriment, discontinue a regular exercise program.

Recent evidence, from work done at Stanford University, for example, indicates that stamina and ability to exercise with intensity may be directly related to core body temperature. It appears that ability to exercise with intensity may be limited in duration by an increase in core body temperature that may occur during exercise. If core body temperature can be lowered during an exercise session, then exercise may be continued for a longer period and/or with a maintained level of intensity with all its ensuing benefits. According to the Stanford University study, core body temperature may be lowered by extracting heat via the palm of the hand, for example, by cooling at the palm coupled with a slightly reduced pressure at the palm.

While the target subjects in the Stanford University study appear to be elite athletes, the basic principle of reducing core body temperature to enhance stamina and endurance during exercise remains valid for people in general. It would be desirable, and of great benefit, for an exerciser to have a method that is simple and convenient and that is effective to increase stamina and endurance during an exercise session. This is particularly true for individuals who, because of poor physical condition, lack the stamina to maintain a sufficiently vigorous exercise program.

A device and method for extracting heat from the palm of a hand is disclosed in U.S. Pat. No. 8,614,745 issued to Warner et al. ("the '745 patent"). The '745 patent discloses a device in the form of an enclosure that includes a cold maintaining substance. The enclosure is held against the palm of a person's hand by way of a strap, buckle, and hook-and-loop fastener arrangement. According to the '745 patent, the enclosure with the cold maintaining substance is placed in a freezer or refrigerated enclosure prior to use and then placed against the palm and held in place by the fastener arrangement either during or after a period of exertion.

While the device of the '745 patent may have an effect on core body temperature, it may not be convenient enough to be effective, particularly for older persons who may need such an effect the most. For example, it may be difficult for older persons to secure the strap and buckle arrangement in place. In addition, the '745 device does not make provision for enhancing a cooling effect by creating a slightly reduced pressure on the palm.

The presently disclosed core cooling accessory and method include improvements in known accessories and methods of the character described.

SUMMARY

In one aspect, a core cooling accessory includes a hand covering configured as a glove having a palm portion and a wrist portion, and the glove includes an outer layer and an inner liner. The core cooling accessory also includes an access opening in the palm portion of the outer layer permitting access between an outer surface of the outer layer and a space between the outer layer and the inner liner. The core cooling accessory also includes a cooling element positioned within the space between the outer layer and the inner liner and adjacent the access opening in the palm portion of the outer layer.

In another aspect, a method of cooling the core of a human body during a session of physical exertion includes engaging in a period of physical exertion for a period of time sufficient to raise core body temperature and then pausing physical exertion. The method also includes, while pausing, donning a glove on a hand, the glove including a wrist portion, a palm portion, an outer layer, and an inner liner, and having an opening in the palm portion providing access to an interior space within the glove between the outer layer and the inner liner, the glove also including a back portion covering a back of a hand of a person wearing the glove. The method also includes inserting a cooling element through the opening into the interior space within the glove and starting a timer mechanism, the timer mechanism being secured to the back portion. The method also includes retaining the glove on the hand for a period of time between three and five minutes.

In another aspect, a kit is provided for an accessory to be employed during a session of physical exertion. The kit includes a container constructed of insulating material. The kit also includes at least one glove in the container, the glove including a palm portion, a wrist portion, an outer layer, and an inner liner, a pocket formed on an interior surface of the outer layer in a space between the outer layer and the inner liner, a back portion configured to cover a back of a hand of a person wearing the glove, a timer mechanism secured to the back portion, and a flexible tube on the palm portion and communicating with the interior of the inner liner. The kit also includes at least one cooling element in the container and dimensionally constructed to fit within the pocket of the glove. The kit also includes a set of instructions associated with the container and including information relating to proper use of the accessory.

DETAILED DESCRIPTION

Figure 1:
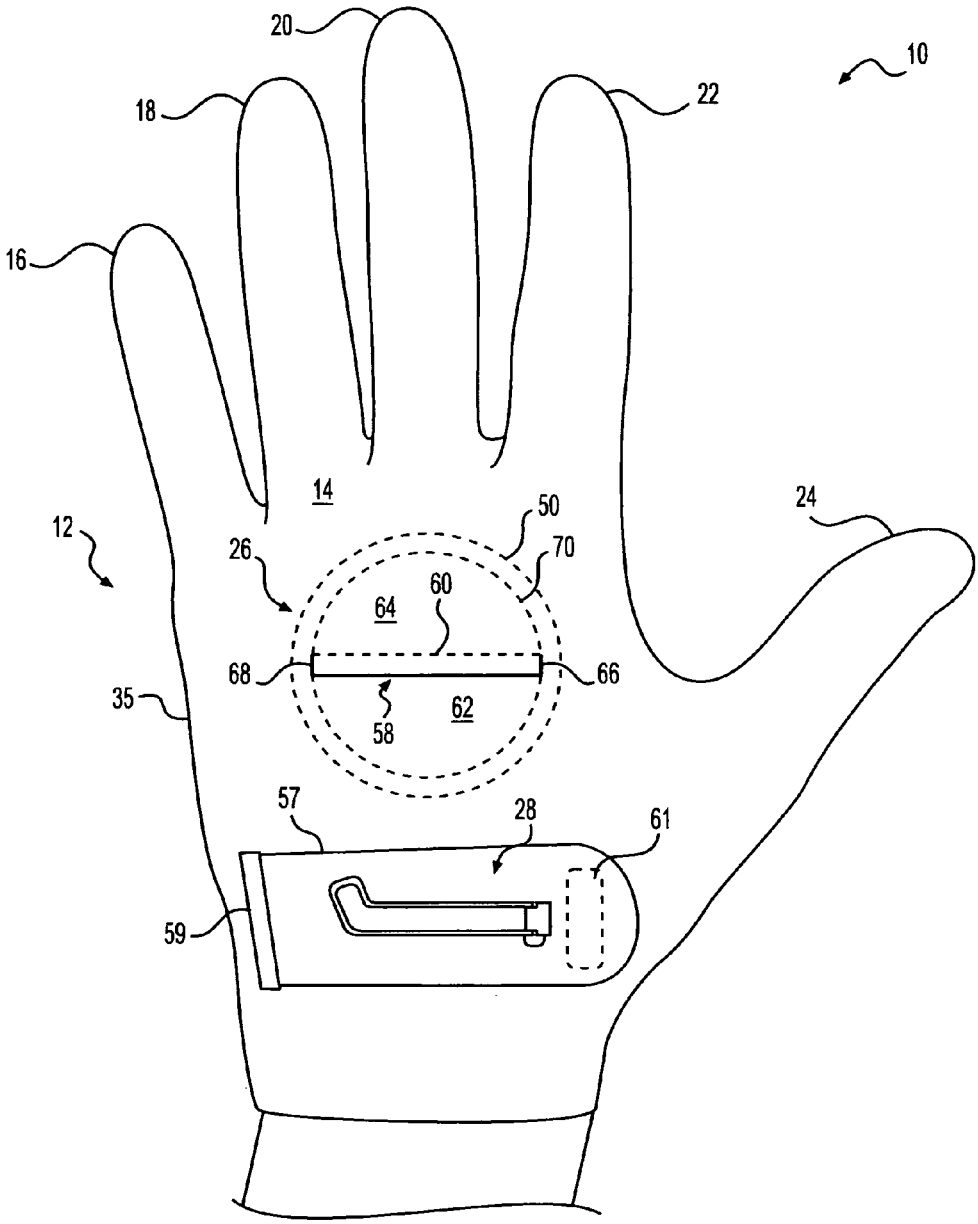
FIG. 1 diagrammatically illustrates an exemplary embodiment of a core cooling accessory.

An exemplary embodiment of a core cooling accessory 10 is diagrammatically illustrated in FIG. 1, for example. Accessory 10 may be embodied in the form of a hand covering shaped as a glove 12. The view of glove 12 in FIG. 1 is that of a palm side 14 of glove 12. Glove 12 may include finger stalls 16, 18, 20 and 22, as well as a thumb stall 24. Palm side 14 of glove 12 may include salient features including an access opening 26 and a tubular member 28, both to be described in more detail subsequently. Glove 12 may be made from any of a number of materials conventionally used to form gloves. For example, glove 12 may be made from various natural or synthetic fabric materials, natural or synthetic leather, or a combination of fabric and leather, and may include mesh material.

Figure 2:
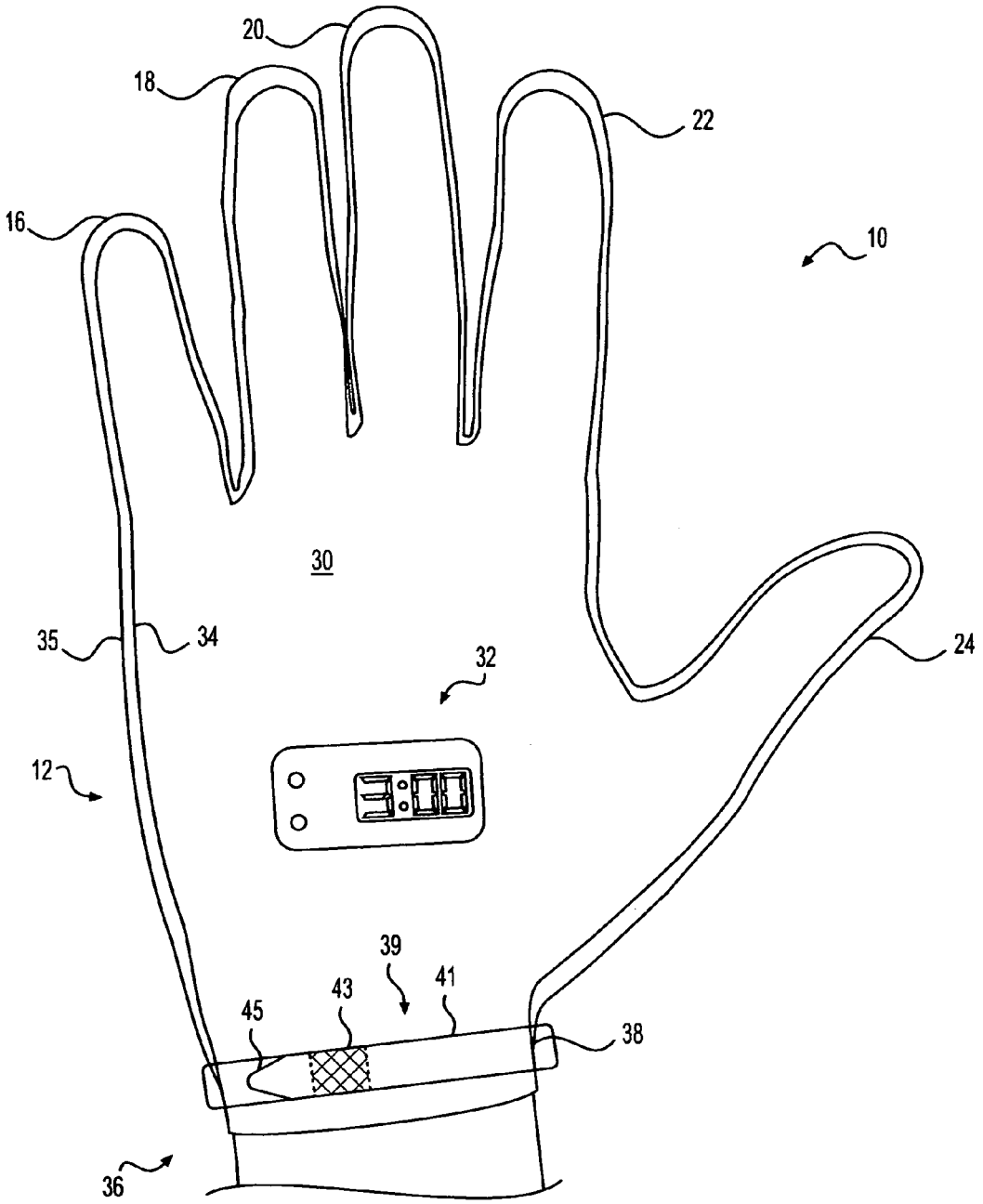
FIG. 2 diagrammatically illustrates additional features of an exemplary embodiment of a core cooling accessory.

FIG. 2 is another view of core cooling accessory 10 illustrating a back side 30 of glove 12. Back side 30 may include an attached timer mechanism 32 to be described in more detail subsequently. Also diagrammatically shown in FIG. 2 is an inner liner 34 for glove 12. Inner liner 34 may not be visible while the glove is on a person's hand, or it may only be visible to the extent it can be seen through any openings in the material of glove 12, such as through mesh material. Inner liner 34 may be made from a material that is substantially impermeable to air. For example, inner liner 34 may be formed from natural or synthetic rubber or from a suitable polymer such as, for example, polyvinyl chloride. Other natural or synthetic materials are contemplated as long as they are substantially impermeable to air.

Referring still to FIG. 2, inner liner 34 may be relatively thin, for example, with a thickness of approximately 1-6 mils. Inner liner 34 may be joined to an outer layer 35 of glove 12 adjacent a wrist portion 36 of glove 12. For example, inner liner 34 may be joined to outer layer 35 at a joint 38 that may extend circumferentially of glove 12 adjacent wrist portion 36. It is also contemplated that inner liner 34 may be joined to outer layer 35 of glove 12 at other locations such as, for example, the ends of finger stalls 16, 18, 20, 22, and the end of thumb stall 24 (not illustrated). The joining of inner liner 34 to glove 12 may be via heat bonding or adhesive bonding, for example.

Back side 30 of glove 12 may include features configured to enable glove 12 to be closely secured to an exerciser's hand. For example, wrist portion 36 may include a closure mechanism 39 capable of ensuring that glove 12 is snugly pressed against an exerciser's wrist. Closure mechanism 39 may be positioned at the location of circumferential joint 38 where outer layer 35 and inner liner 34 are joined. In this way, inner liner 34 may be temporarily sealed against the exerciser's skin adjacent wrist portion 36 for reasons to be described subsequently. Closure mechanism 39 may be of any type generally employed to secure articles of clothing around an arm, leg, or torso, for example.

One embodiment of closure mechanism 39 is diagrammatically illustrated in FIG. 2. Closure mechanism 39 may include a band 41 secured to glove 12 at attachment 43 shown in dotted lines and cross-hatching, for example on the back side 30 of glove 12 as indicated. Band 41 may be capable of being wrapped completely about the wrist of the exerciser adjacent joint 38. It also is contemplated that attachment 43 could be at palm side 14 of glove 12. Band 41 may have one element of hook and loop fastener material on one side, and the other element of hook and loop fastener material on the other side (not illustrated). In this way, band 41 may be snugly wrapped about the wrist and secured to itself at the back side 30 of glove 12 with its end 45 extending to or beyond attachment 43. Because band 41 is situated at the location of circumferential joint 38, inner liner 34 may, at least temporarily, be sealed against the exerciser's skin.

Figure 3:
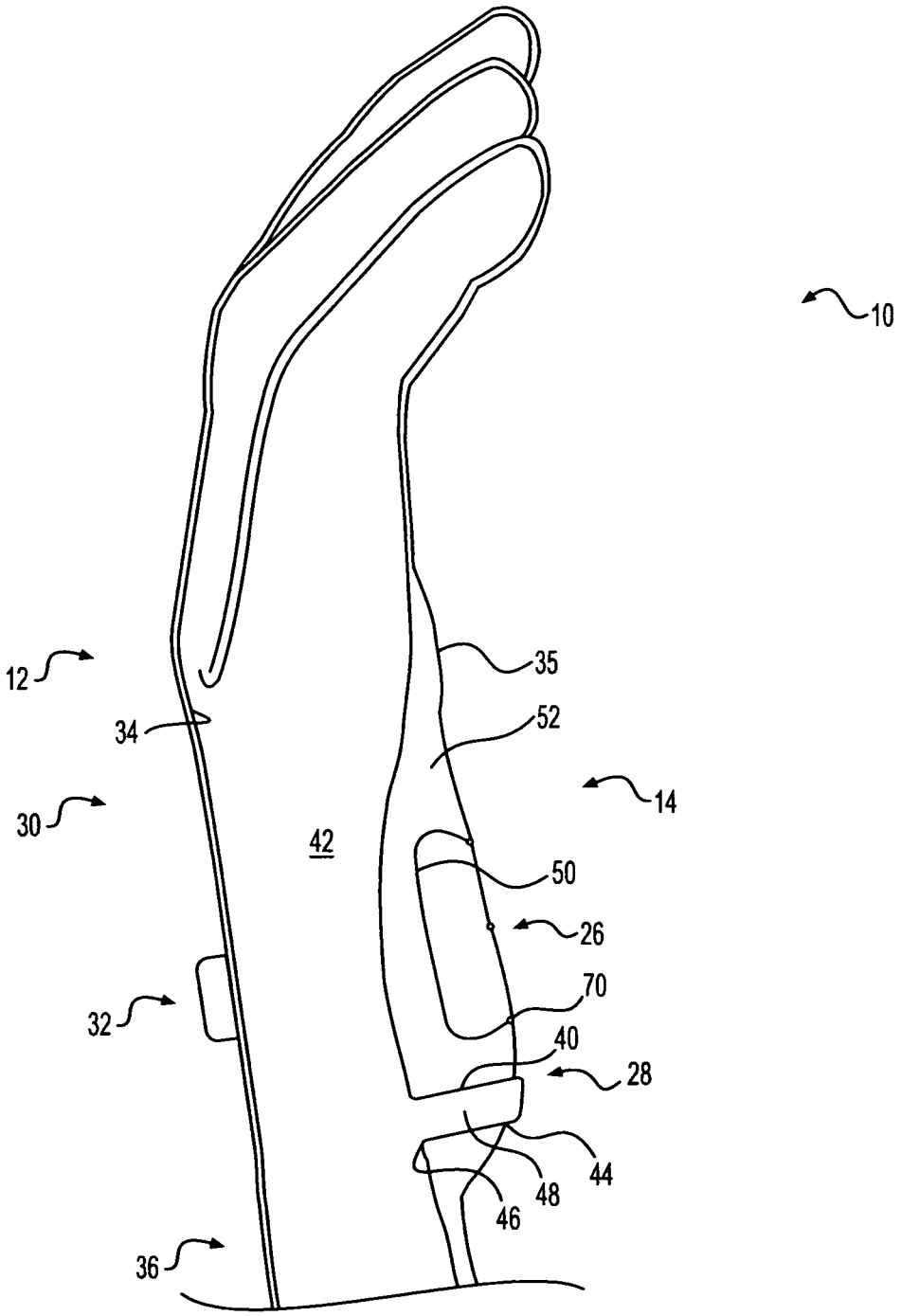
FIG. 3 is a detailed view illustrating aspects of the core cooling accessory.

FIG. 3 is a diagrammatic side view of glove 12 illustrating some of the salient features of palm side 14 and back side 30. Access opening 26 and tubular member 28 may be seen on palm side 14, and timer mechanism 32 may be seen on back side 30. Inner liner 34 also may be seen in FIG. 3. Access opening 26 is diagrammatically shown and may be a simple slit in outer layer 35 of glove 12. Tubular member 28 may include a tubular air passage 40 communicating with the interior 42 of inner liner 34. Tubular air passage 40 may pass through an aperture 44 in outer layer 35 of glove 12 and connect to inner liner 34 at a joint 46 circumferentially of tubular air passage 40. In this way the lumen 48 of tubular air passage 40 may connect the interior 42 of inner liner 34 to ambient. Tubular member 28 may be located adjacent wrist portion 36 of glove 12 and between access opening 26 and wrist portion 36. FIG. 3 also generally illustrates a pocket 50 that may be included adjacent access opening 26 and in the space 52 between inner liner 34 and outer layer 35 of glove 12.

Figure 4:
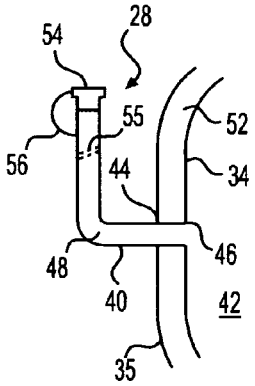
FIG. 4 diagrammatically illustrates further features of an exemplary embodiment of a core cooling accessory.

FIG. 4 is a schematic detailed view of aspects of tubular member 28 and its relationship to inner liner 34 and outer layer 35 of glove 12. As can be seen in FIG. 4, tubular air passage 40 extends from its connection at joint 46 at inner liner 34 through aperture 44 in outer layer 35 of glove 12 to the exterior surface of glove 12. Tubular air passage 40 may be flexible and resilient and may extend a short distance, e.g., 2-6 cm. from its connection at joint 46 at inner liner 34. Tubular air passage 40 may include a closure connected thereto for inhibiting air flow through tubular air passage 40 in at least one direction. In one embodiment, the closure may include a stopper 54 that may be connected to tubular air passage 40 via a flexible connector 56. Stopper 54 may be selectively inserted into the end of tubular air passage 40 to seal interior 42 of inner liner 34 from ambient, and selectively removed from the end of tubular air passage 40 to allow fluid flow between interior 42 and ambient. It also is contemplated that the closure for tubular air passage 40 could include a simple one-way flap valve 55, schematically indicated in dotted lines, connected to tubular air passage 40 and permitting air to be withdrawn from interior 42 to ambient, but inhibiting air flow toward interior 42.

A flap 57 (see FIG. 1) may be provided adjacent wrist portion 36 of glove 12 for covering tubular member 28. Flap 57 is shown schematically in FIG. 1 in dotted lines in a position covering tubular member 28. Flap 57 may be joined to glove 12 at one edge 59, for example by stitching or adhesive bonding, in a position permitting it to be pivotally moved to and from covering tubular member 28. A suitable releasable fastener 61 may be employed to secure flap 57 in its position covering tubular member 28. For example, flap 57 may be provided with one element of a hook and loop fastener assembly, and a small patch of the other element of the hook and loop fastener assembly may be provided on palm portion 14 of glove 12. Accordingly, tubular member 28 may normally be covered by flap 57, but uncovered when it is desired to utilize tubular member 28 to withdraw air from the interior 42 of inner liner 34.

Referring again to FIG. 1, it may be seen that access opening 26, may be embodied as a slit 58 approximately located centrally of palm portion 14. Slit 58 may be formed in glove 12 in various ways. For example, slit 58 may simply be a cut formed in the material of outer layer 35 of glove 12. Alternatively, slit 58 may be formed by portions of outer layer 35 that overlap. In FIG. 1, the dotted line 60 indicates an edge of an underlying portion 62 that is covered slightly by an overlapping portion 64. Accordingly, glove material extending from the wrist side of palm portion 14 may extend beneath the material extending from the finger stall side of palm portion 14 (or vice versa) to an edge indicated by the dotted line 60. The ends of slit 58 may be reinforced by end seams 66 and 68 formed by stitching, heat bonding, or adhesive bonding, depending on the choice of material for outer layer 35 of glove 12. While slit 58 has been diagrammatically illustrated as extending across the width of glove 12, it should be understood that it is contemplated that slit 58 could extend in any direction. For example, slit 58 may extend in a direction generally perpendicular to that shown in FIG. 1 such that it extends in a direction between wrist portion 36 of glove 12 and the finger stalls.

Referring still to FIG. 1, the outer dotted circle generally represents pocket 50 which may be included in space 52 between outer layer 35 and inner liner 34. Inner dotted circle 70 generally represents a connection of pocket 50 to an interior surface of outer layer 35 of glove 12. Thus, as stated above and as seen in FIG. 3, pocket 50 may be attached to outer layer 35 along a connection 70 and may be positioned within space 52 between inner liner 34 and outer layer 35. The space within pocket 50 may be accessed via access opening 26. More specifically, an object may be inserted into or removed from pocket 50 by inserting the object or removing it through slit 58.

Figure 5:
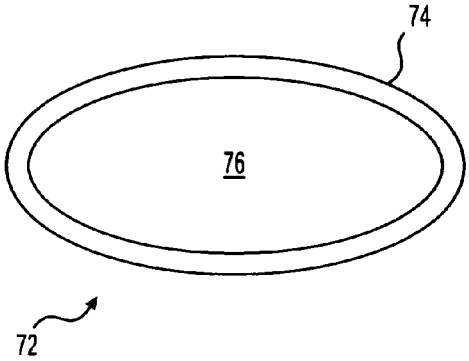
FIG. 5 is a cross-sectional view of an embodiment of a cooling module of a core cooling accessory.

Access to pocket 50 is desirable to facilitate insertion and removal of a cooling module 72, diagrammatically shown in FIG. 5. Accordingly, a cooling module 72 that has been cooled to a desired temperature may be inserted into pocket 50 via slit 58, and later removed. Cooling module 72 may be circular in outline, similar to the stylized shape of pocket 50 illustrated in FIG. 1, so as to form a disc, or lozenge shape, that is thicker near a central portion of the disc than at an edge of the disc, as seen in side view in FIG. 5. Alternatively, cooling module 72 may be any shape that can be inserted conveniently through slit 58 and fit within pocket 50.

Cooling module 72 may include an exterior covering 74 made of a suitable synthetic polymer, such as high density polyethylene, for example. Exterior covering 74 may be in the form of a shell on the order of 10-20 mils in thickness, and may enclose a space filled with a suitable material 76, for example liquid or gel, capable of being frozen and thawed repeatedly. Alternatively, exterior covering 74 may be a fabric enclosure and material 76 may be a suitable granular material such as, for example, buckwheat.

Figure 6:
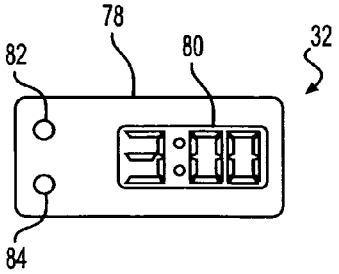
FIG. 6 is a view of an embodiment of a timer mechanism for a core cooling accessory.

FIG. 6 is a diagrammatic illustration of an embodiment of a timer mechanism 32. Timer mechanism 32 may include a suitable housing 78 secured to back portion 30, for example, of glove 12. Housing 78 may include a suitable display 80 giving a visible readout of an elapse of time. The visible readout may be digital or analog. A suitable switch button 82 may be provided on housing 78 for starting and stopping timer mechanism 32 and a suitable switch button 84 may be provided for resetting the timer mechanism to a selected time when desired. Timer mechanism 32 may signal completion of a period of timing by a gentle auditory signal, flashing of display 80, or both. Timer mechanism 32 may be secured to glove 12 by any suitable expedient such as, for example, by a hook and loop fastener or by adhesive.

Figure 7:
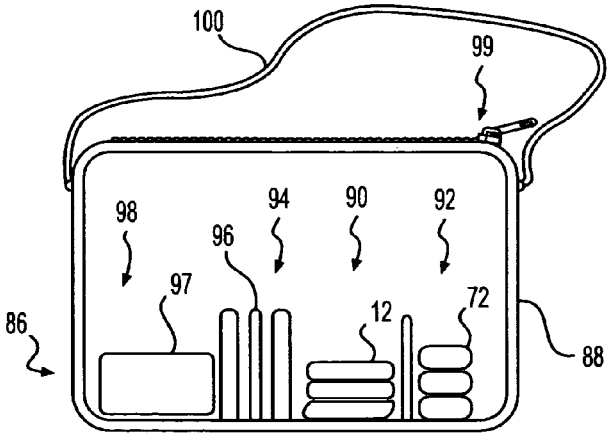
FIG. 7 is a diagrammatic illustration of a kit according to a disclosed embodiment.

FIG. 7 is a diagrammatic illustration of an embodiment of a kit 86 that may be employed to facilitate use of the disclosed core cooling accessory 10. Kit 86 may include a suitable container 88 for components of the disclosed core cooling accessory 10. Container 88 may be, for example, a cooler bag with a zipper closure of the general type commonly used for food or drinks and designed to reduce heat flow between its exterior and interior. Accordingly, container 88 may be an insulated bag, for example a bag with an interior liner formed of a reflective coated polymer.

Container 88 may have a space 90 within its interior to house one or more gloves 12 made in accordance with this disclosure. For example, container 88 may house a left hand glove and a right hand glove, or it may house a single glove or a plurality of gloves adapted for the same hand. Container 88 also may house one or more cooling modules 72, for example within a separate compartment 92. Before being placed within container 88, cooling modules 72 may be kept in a cold environment such as, for example, a home freezer. Accordingly, because container 88 is insulated or otherwise designed to reduce heat flow between its exterior and interior, cooling modules 72 generally may be kept cold for several hours.

Container 88 may include a further compartment 94 configured to hold printed matter and/or a compact disc or digital video disc containing instructions 96 for use of the core cooling accessory 10 and/or other information relating to exercise and use of the core cooling accessory 10. Moreover, container 88 may include an additional compartment 98 configured to hold a suitable food product, for example a beverage 97. Container 88 may include a suitable closure 99, such as a zipper, and a carrying strap or handle 100.

Figure 8:
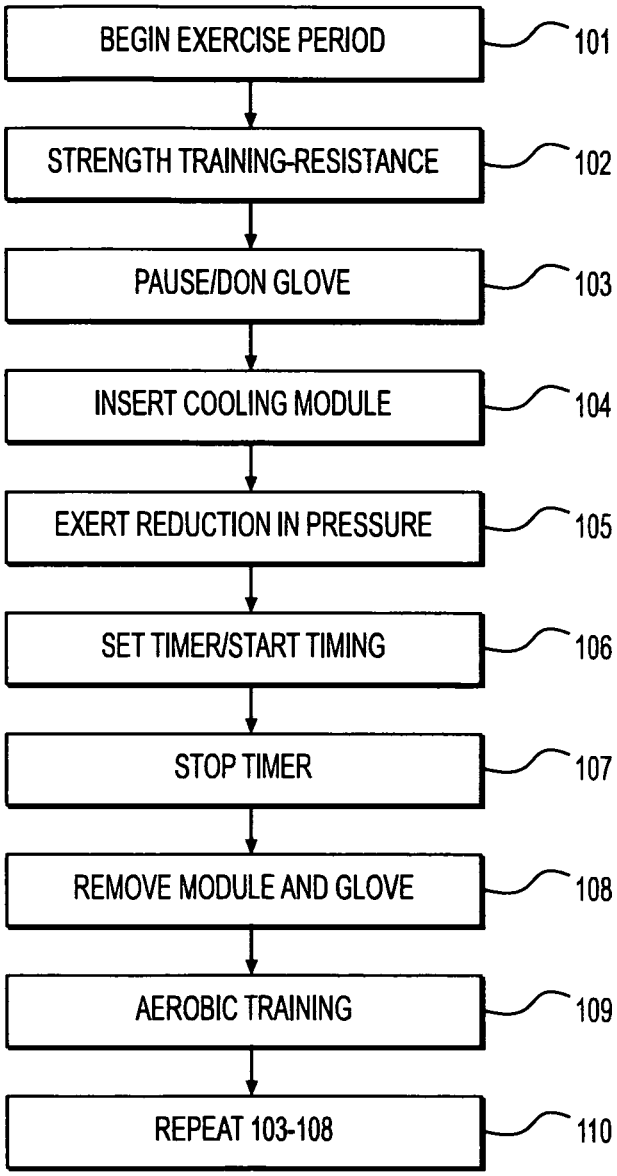
FIG. 8 is a generalized flow diagram illustrating an exemplary method according to a disclosed embodiment.

FIG. 8 is a flow diagram that schematically illustrates one of many possible core cooling methods in accordance with an embodiment of the disclosure. For purpose of describing and illustrating the method, an example will be presented wherein an exerciser has an exercise program that involves an exercise period including strength training followed by aerobic training. Accordingly, the exercise period is begun at 101. Here, the exerciser may be presumed to have a normal core body temperature and otherwise have the ability to exercise at a certain intensity level.

After a desired warm-up, for example, strength training with resistance may take place at 102. Here, the exerciser may go through a series of exercises for the various muscle groups using either machines and/or apparatus commonly available in gyms and health clubs, or using free weights, or using some of machines and/or apparatus and free weights. As exercise begins, the exerciser may be relatively energetic and otherwise capable of maintaining a relatively consistent level of energy output. However, after a period of performing the desired number of sets and repetitions of the various exercises designated for the particular exercise period, the exerciser may begin to tire and experience a reduced capacity to exert optimum effort. This may vary greatly depending on the individual's age, health, and level of fitness.

When tiring and reduced ability to exert sufficient effort occurs, the exerciser may pause from exercising and access a glove 12, for example from a kit 86, and don the glove 12 at 103. Here, the term or phrase "pause from exercising" is intended to embrace both a resting state in which the exerciser may either sit or stand in one position temporarily, and a state of reduced activity in which the exerciser may be walking or otherwise moving about at a significantly reduced level of exertion. Once the glove is donned, the exerciser may then insert a cooling module 72 through access opening 26, at 104, so that cooling module 72 is within pocket 50 in the area between inner liner 34 and outer layer 35. In this position, cooling module 72 will be positioned adjacent the palm of the exerciser's hand. It also is contemplated that cooling module 72 could be inserted prior to donning glove 12.

Once glove 12 is donned and cooling module 72 is inserted through access opening 26, a reduction in pressure may be exerted on the exerciser's hand at 105. First, the exerciser should ensure that securing means 39, such as band 41, securely presses glove 12 against the exerciser's skin adjacent joint 38. The exerciser may access tubular member 28 from beneath flap 57 and may remove stopper 54 from tubular air passage 40, place his or her mouth over the open end of tubular air passage 40, and with minimal force, withdraw the air from between the exerciser's hand and the inner liner 34 through lumen 48 of tubular air passage 40, thus creating a slight reduction in pressure. A seal sufficient to allow the temporary pressure reduction is formed by the pressing of band 41 adjacent joint 38. Once this is accomplished, stopper 54 may then be placed back into tubular air passage 40 to temporarily prevent air from reentering into the spaced between inner liner 34 and the exerciser's hand. Tubular air passage 40 may be sufficiently resilient and flexible to enable a user to briefly pinch tubular air passage 40 to prevent air from reentering the interior of inner liner 34 while stopper 54 is replaced. As has been stated above, a suitable one-way valve 55 may be located in tubular air passaged 40, either in addition to stopper 54 or in lieu of employing a stopper, thus permitting withdrawal of air and prevention of its reentry by the one-way valve.

At this point timer mechanism 26 may be activated by setting a desired time via switch button 84, at 106. For example, it has been determined that a time period between approximately three and five minutes is generally sufficient to exert a desired core cooling effect. Once the desired time has been set, timing may begin by pressing start/stop button 82. The exerciser may then either sit or stand in a resting state while the time passes, or may move about, for example by walking. Once the set time has passed, timer mechanism 26 may signal completion, either by an auditory or visual signal, and timer mechanism 26 may be stopped, at 107, either automatically or by again pressing start/stop button 82.

Cooling module 72 may be removed from glove 12, and glove 12 may be removed, at 108. Either glove 12 may be removed before cooling module 72 is removed from glove 12, or glove 12 may be removed and then cooling module 72 may be removed from glove 12. Both cooling module 72 and glove 12 may be returned to insulated container 88, for example, of kit 86. Exercise may then resume, and in an exemplary embodiment, a session of aerobic training may begin, at 109. After a period of exercise, the exerciser may again tire and incur a reduced ability to exert sufficient effort. At that point, at 110, the exerciser may again follow the procedure indicated in boxes 103-108 of FIG. 8 as described above. The sequence of training for a period of time until reduced ability to exert sufficient effort occurs, and then acting in accordance with boxes 103-109, may be repeated until the exercise period is completed.

PRACTICAL APPLICABILITY

The disclosed embodiments of a core cooling accessory 10 may be employed to cool core body temperature during an exercise period in order to enhance recovery from an episode of exertion and enable the exerciser to continue with the exercise period and maximize the benefits of exercise. Because core cooling accessory 10 enables convenient heat dissipation from the glabrous tissue located at the palm of a person's hand, it aids reduction of an exerciser's core body temperature more rapidly than would otherwise occur. Notably, elderly or infirmed persons, or those who may have long neglected their physical fitness and who choose to pursue an exercise routine to benefit their health and well-being may avail themselves of the disclosed core cooling accessory to enhance their ability to follow through and receive the well-known benefits of a regular exercise program.

Those persons who choose to participate in exercise programs in gyms and other exercise facilities such as health clubs often carry various objects with them. For example, exercisers frequently have a water bottle, a towel, a clipboard or notebook to record their exercises, a mobile telephone device, or a device for listening to music with them as they move through their exercise routine. Others may keep a gym bag nearby as they exercise. It is not infrequent for a woman to keep her purse close at hand during exercise. Similarly, the disclosed kit 86 may be conveniently kept close at hand by those who wish to avail themselves of the disclosed core cooling accessory 10.

At any time during a period of exercise when an exerciser feels a reduced capacity for putting forth sufficient effort, she or he may simply pause for a brief rest, don a glove 12 from kit 86, insert a cooling module 72 through slit 58 into pocket 50, manually withdraw air from the interior of inner liner 34 to reduced pressure adjacent the palm of the hand, and activate timer mechanism 32. Body core heat dissipation through the glabrous tissue of the hand covered by the glove 12 may then be enhanced by the close contact of cooling module 72 and further enhanced by the reduction in pressure at the palm of the hand. As has been stated above, the brief rest may include sitting, standing, walking, or otherwise substantially reducing the level of activity.

While disclosed embodiments include a pocket 50 adjacent access opening 26 and between outer layer 35 and inner liner 34 into which a cooling module 72 may be inserted, it also is contemplated that cooling module 72 may alternatively be inserted into the space 52 between outer layer 35 and inner liner 34 without the use of a pocket 50. Accordingly, while pocket 50 may more definitively confine cooling module 72 against the target area of the center of the palm, sufficient close contact of a cooling module 72 and the palm may be achieved without a pocket inasmuch as space 52 between inner liner 34 and outer layer 35 is itself relatively confined.

While exemplary embodiments have been disclosed, other embodiments will be apparent to those having ordinary skill in the art from consideration of the specification and practice of the disclosed embodiments. Exemplary embodiments have been schematically illustrated, and the illustrations are not necessarily to scale. Some sizes may be exaggerated to aid illustration and accompanying description, as will be recognized by those having ordinary skill in the art. It is intended that the specification and examples be considered as exemplary only with the true scope of protection being indicated by the following claims.

What I claim is:

1. A method of cooling the core of a human body during a session of physical exertion, comprising:

engaging in a period of physical exertion for a period of time sufficient to raise core body temperature;

pausing physical exertion;

while pausing, donning a glove on a hand, the glove including a wrist portion, a palm portion, an outer layer, and an inner liner, and having an opening in the palm portion providing access to an interior space within the glove between the outer layer and the inner liner, the glove also including a back portion covering a back of a hand of a person wearing the glove;

inserting a cooling element through the opening into the interior space within the glove;

manually withdrawing air from the interior of the inner liner through a flexible tube on the palm portion adjacent the wrist portion and communicating with the interior of the inner liner, wherein manually withdrawing air includes withdrawing air by using the mouth of the person wearing the glove to create a reduction in pressure between the hand of the person wearing the glow and the inner liner;

starting a timer mechanism, the timer mechanism being secured to the back portion; and retaining the glove on the hand for a period of time between three and five minutes.

2. The method of claim 1, wherein the inner liner is joined to the outer layer at a connection adjacent the wrist portion of the glove, and wherein the opening is a slit in the outer layer, and wherein inserting the cooling element through the opening includes inserting the cooling element into a pocket positioned between the inner liner and the outer layer.

3. The method of claim 2, further including securing the glove to the wrist adjacent the wrist portion and the connection of the inner liner to the outer layer by a band.

4. The method of claim 1, wherein manually withdrawing air from the interior of the inner liner through a flexible tube includes accessing the flexible tube from beneath a flap provided adjacent the wrist portion of the glove.

5. The method of claim 4, further including removing a stopper from the flexible tube before withdrawing air.

6. The method of claim 1, wherein the inner liner is joined to the outer layer at a connection adjacent the wrist portion of the glove, further including securing the glove to the wrist adjacent the wrist portion and the connection of the inner liner to the outer layer by a band.

7. The method of claim 6, further including pressing the band against the connection to form a seal sufficient to allow temporary pressure reduction within the interior of the inner liner.

8. The method of claim 1, including closing the flexible tube with a stopper after manually withdrawing air.

9. The method of claim 8, further including briefly pinching the flexible tube while closing it with the stopper to prevent air from reentering the interior of the inner liner.

10. The method of claim 1, further including taking the glove from an insulated container before donning the glove.

11. The method of claim 10, further including taking the cooling element from the insulated container before inserting it through the opening into the interior space within the glove.

12. The method of claim 1, further including removing the cooling module from the glove and then removing the glove.

13. The method of claim 12, further including placing the glove and the cooling module into an insulated container.

14. A method of cooling the core of a human body during a session of physical exertion, comprising:

engaging in a period of physical exertion for a period of time sufficient to raise core body temperature;

pausing physical exertion;

while pausing, donning a glove on a hand, the glove including a wrist portion, a palm portion, an outer layer, and an inner liner, and having an opening in the palm portion providing access to a pocket, the glove also including a back portion covering a back of a hand of a person wearing the glove;

inserting a cooling element through the opening into the pocket;

withdrawing air from the interior of the inner liner through a flexible tube communicating with the interior of the inner liner, wherein manually withdrawing air includes withdrawing air by using the mouth of the person wearing the glove to create a reduction in pressure between the hand of the person wearing the glow and the inner liner;

starting a timer mechanism, the timer mechanism being secured to the back portion; and retaining the glove on the hand for a period of time of at least three minutes.

15. The method of claim 14, wherein the inner liner is joined to the outer layer at a connection adjacent the wrist portion of the glove, and further including pressing a band against the connection to form a seal sufficient to allow temporary pressure reduction within the interior of the inner liner.

16. The method of claim 14, wherein withdrawing air from the interior of the inner liner through a flexible tube includes accessing the flexible tube from beneath a flap provided adjacent the wrist portion of the glove.

17. The method of claim 16, further including briefly pinching the flexible tube while closing it with a stopper to prevent air from reentering the interior of the inner liner.

18. A method of cooling the core of a human body during a session of physical exertion, comprising:

engaging in a period of physical exertion for a period of time sufficient to raise core body temperature;

pausing physical exertion;

while pausing, donning a glove on a hand, the glove including a wrist portion, a palm portion, an outer layer, and an inner liner, and having an opening in the palm portion providing access to an interior space within the glove between the outer layer and the inner liner, the glove also including a back portion covering a back of a hand of a person wearing the glove, and wherein the inner liner is joined to the outer layer at a connection adjacent the wrist portion of the glove;

inserting a cooling element through the opening into the interior space within the glove;

securing the glove to the wrist adjacent the wrist portion and the connection of the inner liner to the outer layer by a band, and pressing the band against the connection to form a seal sufficient to allow temporary pressure reduction within the interior of the inner liner;

accessing a flexible tube communicating with the interior of the inner liner from beneath a flap provided adjacent the wrist portion of the glove;

removing a stopper from the flexible tube;

withdrawing air from the interior of the inner liner through the flexible tube by using the mouth of the person wearing the glove to create a reduction in pressure between the hand of the person wearing the glove and the inner liner;

briefly pinching the flexible tube while closing it with a stopper to prevent air from reentering the interior of the inner liner;

starting a timer mechanism, the timer mechanism being secured to the back portion; and retaining the glove on the hand for a period of time between three and five minutes.

* * * * *